US006464335B2

(12) United States Patent
Suzuki

(10) Patent No.: US 6,464,335 B2
(45) Date of Patent: Oct. 15, 2002

(54) INK JET PRINTER FOR REDUCING DOT SHIFT

(75) Inventor: Hiroshi Suzuki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/880,895

(22) Filed: Jun. 15, 2001

(65) Prior Publication Data

US 2001/0052915 A1 Dec. 20, 2001

(30) Foreign Application Priority Data

Jun. 15, 2000 (JP) ..... 2000-179246

(51) Int. Cl.[7] ..... B41J 2/21
(52) U.S. Cl. ..... 347/43; 347/15; 347/41
(58) Field of Search ..... 347/41, 43, 12, 347/15, 18

(56) References Cited

U.S. PATENT DOCUMENTS 6,341,840 B1 * 1/2002 Van Doorn et al. ..... 347/41
6,354,692 B1 * 3/2002 Ross ..... 347/41

FOREIGN PATENT DOCUMENTS

EP 0 938 976 A1 9/1999
JP 62-77951 A 4/1987
JP 5-301353 A 11/1993

* cited by examiner

*Primary Examiner*—Lamson Nguyen
(74) *Attorney, Agent, or Firm*—Oliff & Berridge, PLC

(57) ABSTRACT

In an ink jet printer of the type having two separate heads mounted on a carriage, alignment errors of the nozzles in the two heads occurring in the main scanning direction are reduced to improve print quality. To this end, a print paper is moved a relevant amount after the firstly actuated head completes printing of the dots during one scan and before the secondly actuated head starts printing the dots in the subsequent scan.

15 Claims, 8 Drawing Sheets

INK JET PRINTER FOR REDUCING DOT SHIFT

BACKGROUND OF THE INVENTION

1. Field of the Invention

The present invention relates to an ink jet printer, and more particularly to a color ink jet printer in which occurrence of dot shift is substantially eliminated.

2. Description of the Related Art

In a color ink jet printer of the type having two print heads, ink droplets ejected from the nozzles in the corresponding locations of the two heads will be shifted in the widthwise direction of a print paper if the print heads are not accurately positioned as shown in FIG. 1(D). In FIG. 1(D), denoted by reference numeral 25*a* is a nozzle array formed in one head for ejecting black ink, and denoted by reference numeral 25*b* is a nozzle array formed in the other head for ejecting magenta ink.

To solve the above-described problem, the conventional printer employs an ink jet head formed with sixty-six (66) nozzles for each color ink in which sixty-four (64) nozzles out of sixty-six (66) are used for printing. By the inclusion of two superfluous nozzles, it is contemplated to reduce the amount of dot shift in a manner to be described below.

FIG. 2(A) shows black (K) and magenta (M) dot arrays printed by the two heads each formed with sixty-four nozzles. FIG. 2(B) shows the similar dot array patterns printed by the heads each formed with sixty-six nozzles. As shown in FIG. 2(A), the #1 magenta dot is downwardly shifted L1 from the black dot in the corresponding location, i.e , #1. When the dots are printed with the heads having sixty-four nozzles using all the nozzles, such a large dot shift L1 is liable to occur due to the head assembling reasons.

However, with the heads having sixty-six nozzles, the dot shift L2 between the #0 magenta dot and the #1 black dot is smaller than L1. Therefore, for the dot shift pattern as shown in FIG. 2(B), the conventional method uses the #1 to #64 black nozzles and #0 to #63 magenta nozzles but does not use #0 and #65 black nozzles and #64 and #65 magenta nozzles, For the dot shift pattern opposite to that shown in FIG. 2(B), that is, the magenta dot array is printed upward relative to the black dot array, the #1 to #64 magenta nozzles and #0 to #63 black nozzles are used for printing but #0 and #65 magenta nozzles and #64 and #65 black nozzles are not used therefor.

However, the dot shift reducing contemplation with the use of such heads is not satisfactory for a recent color ink jet printer that requires high precision printing capability.

SUMMARY OF THE INVENTION

It is an object of the present invention to provide an ink jet printer that is capabale of printing images, characters, symbols and the with high precision. The ink jet printer of the invention employs two or more separate heads mounted on a carriage with nozzle arrays being formed in each of the heads.

To achieve the above and other objects, there is provided an ink jet printer that includes: a carriage motor, a head assembly, a paper feed motor, driving means, and control means. The head assembly includes a carriage and two or more heads mounted on the carriage. The carriage is operatively connected to the carriage motor and reciprocally moved back and forth in a main scanning direction to perform successive scans. Each of the two or more heads is formed with at least one nozzle array having a plurality of nozzles aligned at an equi-pitch in an auxiliary scanning direction perpendicular to the main scanning direction. To print dots on a plurality of dot lines, a series of scans are performed. The paper feed motor is provided for moving a print paper in the auxiliary scanning direction. The driving means is provided for driving the two or more heads to eject ink droplets from the plurality of nozzles. The driving means is provided for driving different heads individually during different scans. During each scan, each of the two or more heads completes printing of dots on a zone determined by a position in the auxiliary scanning direction of the each of the two or more heads mounted on the carriage. The control means is provided for controlling the paper feed motor to move the print paper a relevant amount each time the each of the two or more heads completes printing of the dots on the zone. A memory may further be provided for storing first set data. The first set data contains data regarding paper feed amount of the print paper to be moved by the paper feed motor each time the each of the two or more heads completes printing of the dots on the zone. The control means controls the paper feed motor based on the first set data. The first set data further contains data regarding which head among the two or more heads is to be actuated first among others in a first scan of the series of scans. The driving means firstly drives the head designated by the first set data in the first scan of the series of scans. An amount of movement of the print paper each time the each of the two or more heads completes printing of the dots on the zone is determined on a head basis.

According to another aspect of the invention, there is provided an ink jet printer that includes; a carriage motor, a head assembly, a paper feed motor, a memory, driving means, and control means. The head assembly has a similar structure, however, each of the heads is formed with at least one nozzle array having a plurality of nozzles and at least one superfluous nozzle. The memory stores first set data regarding paper feed amount to be moved by the paper feed motor each time the each of the two or more heads completes printing of the dots on the zone and second data regarding nozzles selected from the plurality of nozzles and at least one superfluous nozzle in each of the two or more heads. The nozzles are selected so that alignment errors of the nozzles in the two or more heads in the main scanning direction become minimum. The selected nozzles are used for ejecting ink droplets from the each of the two or more heads. The control means controls the paper feed motor based on the first set data. The driving means drives the two or more heads to eject ink droplets from the selected nozzles. The control means controls the paper feed motor to move the print paper each time the each of the two or more heads completes printing of the dots on the zone.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

A color ink jet printer according to a first embodiment of the invention will be described while referring to the accompanying drawings.

Figure 1A:
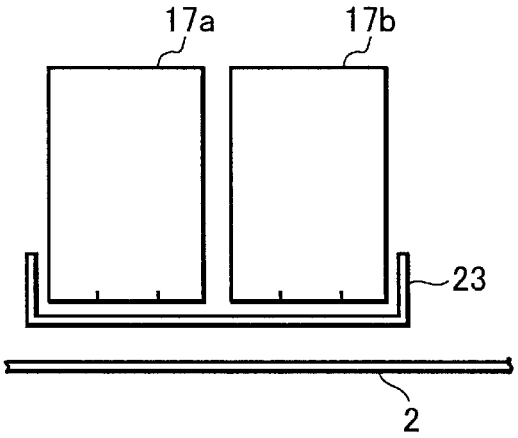
FIG. 1(A) is a front view of a head assembly of a color ink jet printer to which the present invention is applied.
Figure 1B:
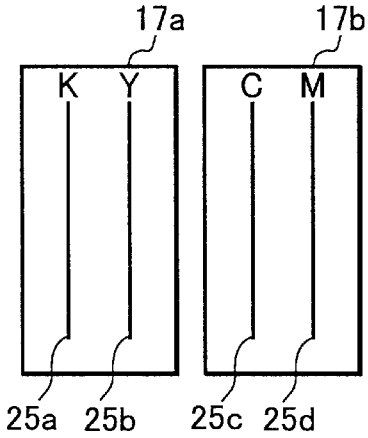
FIG. 1(B) is a bottom view of the head assembly of the color ink jet printer to which the present invention is applied.
Figure 1C:
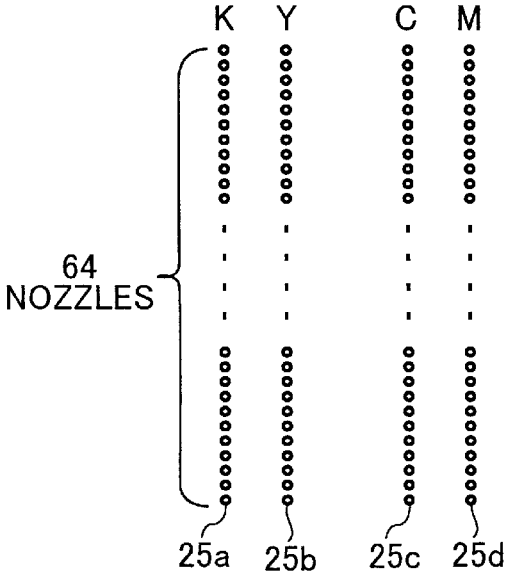
FIG. 1(C) is an enlarged diagram showing nozzle arrays formed in the head assembly shown in FIGS. 1(A) and 1(B)
Figure 1D:
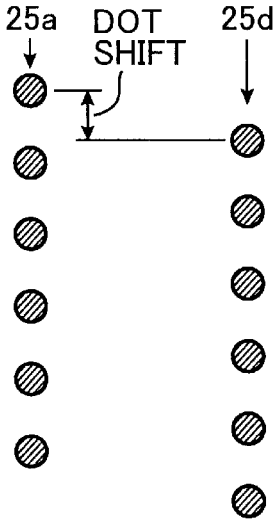
FIG.1(D) PRIOR ART
FIG. 1(D) is an explanatory diagram showing two nozzle arrays in a conventional color ink jet printer.

The present invention is applied to a color ink jet printer of the type in which two ink jet heads are separately mounted on the same carriage in a side-by-side fashion. FIG. 1(A) is a front view of the printer with the nozzle surface oriented downward. FIG. 1(B) is a bottom view showing the nozzle surface. As shown in FIG. 1(B), the first ink jet head 17*a* is formed with a black (K) nozzle array 25*a* and a yellow (Y) nozzle array 25*b*. The second ink jet head 17*b* is formed with a cyan (C) nozzle array 25*c* and a magenta (M) nozzle array 25*d*. As shown in FIG. 1(C), each nozzle array includes sixty four (64) nozzles (numbered from 0 to 63) aligned in the auxiliary scanning direction (i.e., paper feed direction or direction perpendicular to the main scanning direction) at an equi-pitch. Hereinafter, the same numbered nozzles in the four arrays, for example, the #3 nozzle in the black nozzle array and the #3 nozzle in the magenta nozzle array, will be referred to as "the corresponding nozzles" or "the nozzles in the corresponding locations".

In the ink jet printer of the type shown in FIGS. 1(A) through 1(C), a carriage 23 on which the two separate heads 17*a* and 17*b* are mounted reciprocally moves forward and backward in the main scanning direction (i.e., widthwise direction of the print paper 2). During the movement of the carriage 23 from one side to the other, the head 17*a* is activated whereas the head 17*b* is deactivated. During the back way of the carriage 23, activation and deactivation of the two heads are reversed. Such a printing method will be referred to in this description as "an interlace printing methods".

The ink droplets ejected from the corresponding nozzles will be in alignment with one another in the widthwise direction of the print paper 2 if black (K) and yellow (Y) ink droplets are ejected from the head 17*a* during one way movement of the carriage 23 moving from the first extreme to the second extreme and if cyan (C) and magenta (M) ink droplets are ejected from the head 17*b* during the back way movement of the carriage 23 moving from the second extreme to the first extreme at which no paper feed operation is performed during the reversing period of the carriage 23 in the second extreme. However, this is not true if the heads 17*a* and 17*b* are not precisely accurately mounted on the carriage 23 as described previously. While using two separate heads is advantageous in terms of running cost because only a counterpart head may be replaced with a new one when a particular ink is used up, the displacement of the two heads is inevitable. The present invention provides a solution to the dot shift problem caused by the displacement of the two heads.

Figure 3:
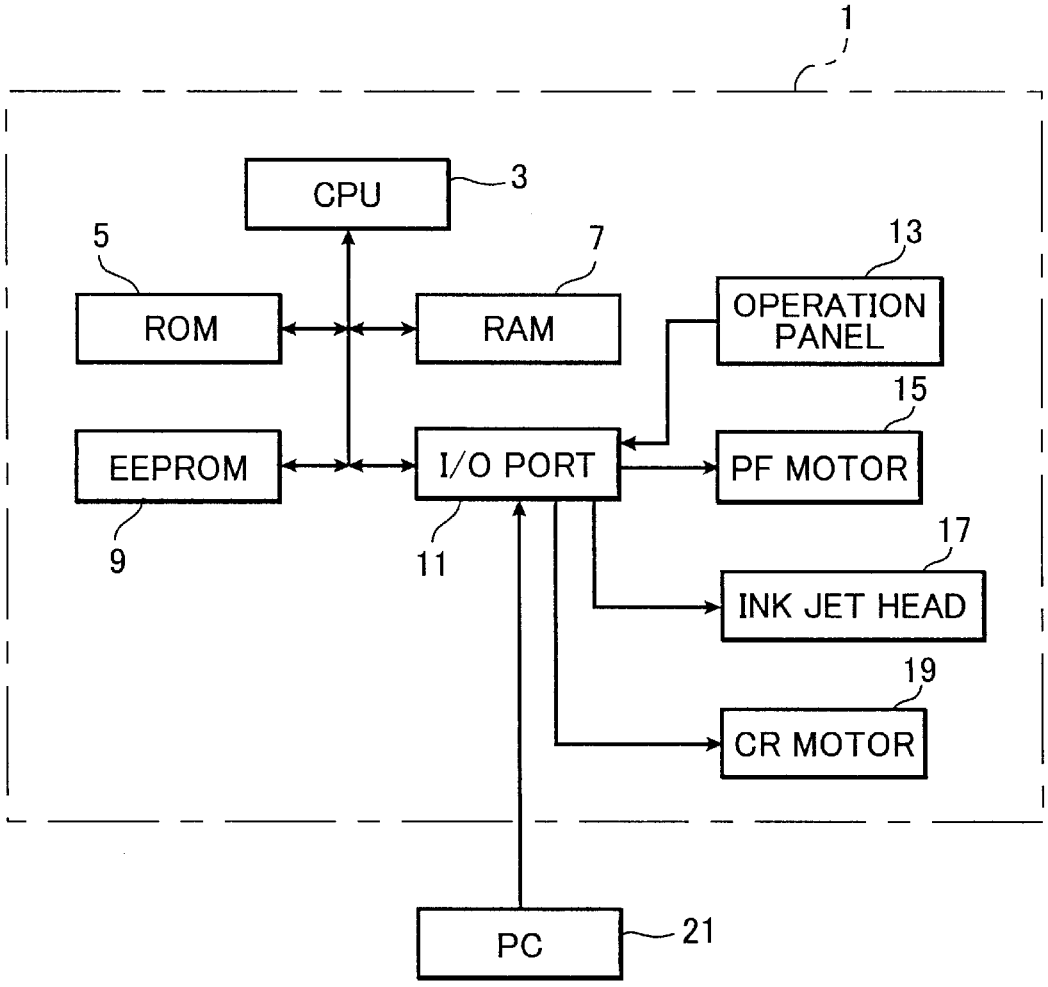
FIG. 3 is a block diagram showing the arrangement of a control system of the color ink jet printer according to the present invention.

The color ink jet printer of the invention is provided with a control system 1 that includes a CPU 3, a ROM 5, a RAM 7, an EEPROM 9 and an I/O port 11, as shown in FIG. 3. Connected to the I/O port 11 are an operation panel 13, a paper feed (PP) motor 15, an ink jet head assembly 17 including heads 17*a* and 17*b*, and a carriage (CR) motor 19. The printer receives print data from a personal computer (PC) 21 through the I/O port 11. In response to the print data, the CPU 3 outputs control signals to the paper feed motor 15, the ink jet heads 17*a* and 17*b*, and the carriage motor 17 to print dots on a print paper 2.

The CPU 3 executes various control processes to be described later. The ROM 5 stores various programs and control data that are necessary for the CPU 3 to execute the control processes. The RAM 7 is used as a print data memory and a work area that allows the CPU 3 to execute the control processes. In the invention, the EEPROM 9 is used for storing various pieces of information regarding the ink jet heads 17*a* and 17*b* when a test printing is performed before shipment.

In order to see the dot shift occurring between the dots printed by the nozzles in the corresponding locations in the two separate heads 17*a* and 17*b*, a test printing is performed. This test printing is performed before shipment of the printer. Based on the results of the test printing, information about the dot shift is obtained. The information is used to eliminate the dot shift when the printer is actually used by a user after shipment of the same from the manufacturer.

In the test printing, the black nozzle array 25*a* in the head 17*a* and the magenta nozzle array 25*d* in the head 17*b* are used to print dots. Then, investigation is made with respect to an amount of dot shift in the auxiliary scanning direction and also the direction in which the shift occurs.

Figure 4A:
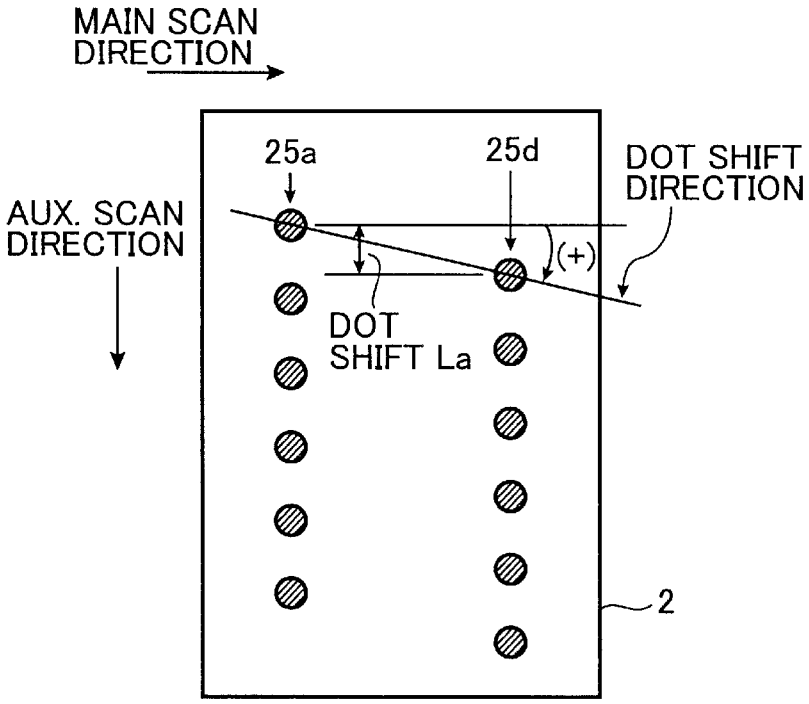
FIG. 4(A) is an explanatory diagram showing a first pattern of a dot shift.
Figure 4B:
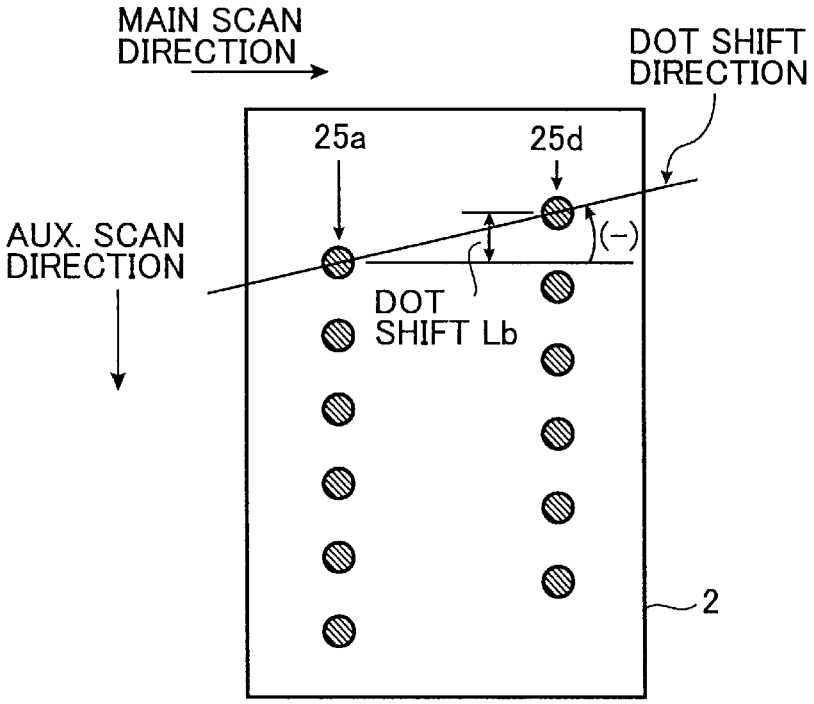
FIG. 4(B) is an explanatory diagram showing a second pattern of the dot shift.

Specifically, two types of dot shift occur, one being shown in FIG. 4(A) and the other in FIG. 4(B). FIGS. 4(A) and 4(B) show dot arrays printed by the black nozzle array 25*a* and magenta nozzle array 25*b*. In the case of FIG. 4(A), the amount of dot shift is La and the direction in which the dot shift occurs is plus (+) which indicates that the line connecting the corresponding two dots is inclined rightside down relative to the main scanning direction. In the case of FIG. 4(B), the amount of dot shift is Lb and the direction in which the dot shift occurs is minus (−) which indicates that the line connecting the corresponding two dots is inclined rightside up relative to the main scanning direction. It should be noted that in FIGS. 4(A) and 4(B), the dots are depicted enlarge relative to the size of the print paper 2 and the amount of dot shift is overly depicted much more than the actuality.

Based on the test print results, how much the vertical position of the print paper 2 needs to be adjusted is determined, In the case of FIG. 4(A), the direction in which the dot shift occurs is plus (+), so the dot shift can be eliminated if the black dots are firstly printed with the leftside head 17*a* and then the print paper 2 is upwardly fed by a distance La immediately before printing the magenta dots with the head 17*b*. It should be noted that the print paper 2 can only be fed in one direction. Therefore, the black dots need to be firstly printed in this case. In the case of FIG. 4(B), the direction in which the dot shift occurs is minus (−), so the magenta dots needs to be firstly printed and then the print paper 2 is upwardly fed by a distance Lb immediately before printing the black dots.

It should further be noted that the minimum sheet feed capability of the printer in this embodiment is a half the nozzle pitch. With the printer 1 of 300 dpi (dots per inch) resolution, the nozzle pitch is equal to 1/150 inch, so the minimum sheet feed amount by the printer 1 is 1/300 inch (hereinafter this 1/300 inch will be referred to as one unit). Based on the investigated dot shift, it is determined how many units the print paper 2 must be fed to align the dots printed by the two heads 17*a* and 17*b*. The number of units thus determined is stored in the EEPROM 9 and also the direction in which the dot shift occurred as the first set data. Storage of the first set data in the EEPROM 9 is made through the manipulation of the operation panel 13.

Figure 5:
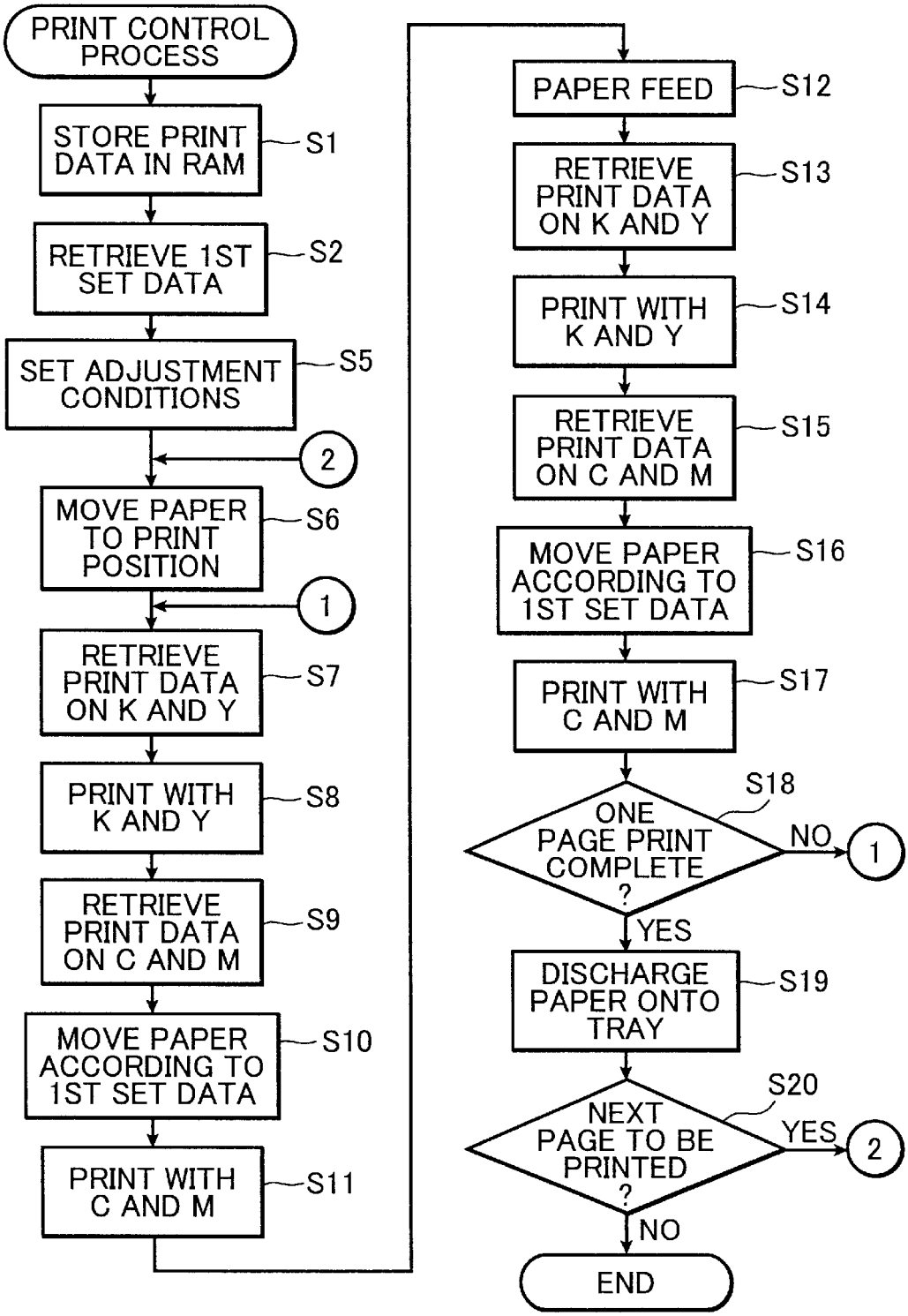
FIG. 5 is a flowchart illustrating a print control process according to a first embodiment of the invention.

A print control process will next be described with reference to the flowchart of FIG. 5.

First, the print data input from the personal computer 21 is stored in the RAM 7 (S1), and then the first set data is retrieved from the EEPROM 9 (S2). Based on the first set data, dot shift adjustment conditions are set (s5). The adjustment conditions includes designation of the head to be actuated first and also a paper feed amount for correcting the dot shift. After setting the adjustment conditions, the print paper 2 is transported by the paper feed motor 15 to the position where printing starts (S6).

One scan worth of print data corresponding to black and yellow is retrieved from the print data stored in the RAM 7 (S7) if the adjustment conditions indicate that the head 17*a* is to be actuated first. The flowchart in FIG. 5 is assumed to be the case. The carriage motor 19 is driven to move the carriage 23 in the main scanning direction. While moving the carriage 23 in the main scanning direction, the print head 17*a* carries out printing (S8). After the print operations with the head 17*a,* one scan worth of print data corresponding to cyan and magenta are retrieved from the print data stored in the RAM 7 (S9). The paper feed motor 15 is driven to move the recording paper 2 a predetermined distance in the auxiliary scanning direction based on the first set data (S10). Then, the carriage motor 19 is driven to move the carriage 23 in the main scanning direction and printing is carried out by the print head 17*b* (S11).

Next, based on a predetermined paper feed amount stored in the ROM 3, the paper feed motor 15 is driven to move the print paper 2 for printing subsequent one scan worth of print data (S12). The black and yellow print data for the subsequent one scan is retrieved from the data stored in RAM 7 (S13). The carriage motor 19 is driven to move the carriage 23 in the main scanning direction. During the movement of the carriage 23, the print head 17*a* carries out printing (S14). Similarly, the print data corresponding to the cyan and magenta is retrieved from the RAM 7 (S15). Similar to the operations executed in S10, after moving the print paper 2 a predetermined distance in the auxiliary scanning direction (S16), the carriage motor 19 is driven to move the carriage 23 in the main scanning direction, during which time the print head 17*b* carries out printing (S17).

Upon execution of S17, determination is made as to whether or not one page print is complete (S18). When one page print is not yet complete (S18: NO), the routine returns to S7 where the above-described processes are executed. On the other hand, when one page print is complete (S18: YES), the paper feed motor 15 is driven to discharge the print paper 2 onto a discharge tray (S19). Next, determination is made as to whether or not there remains print data for the subsequent page (S20). When the print data for the subsequent page remains (S20: YES), the processes of S6 and on are repeatedly executed. When there is no print data for the subsequent page (S20: NO), the processes end.

Figure 2A:
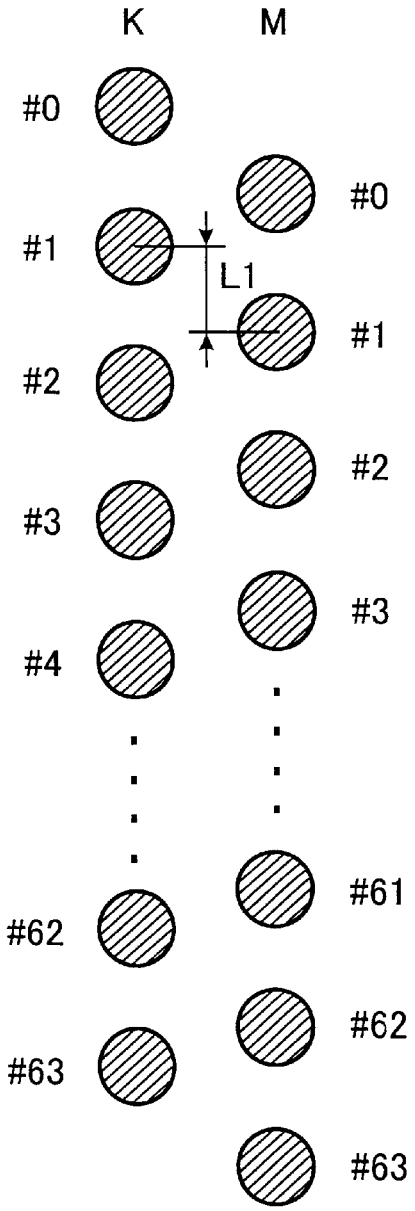
FIG.2(A) PRIOR ART
FIG. 2(A) is an explanatory diagram showing printed dot patterns by the two separate heads each formed with sixty-four nozzles for each color ink.
Figure 2B:
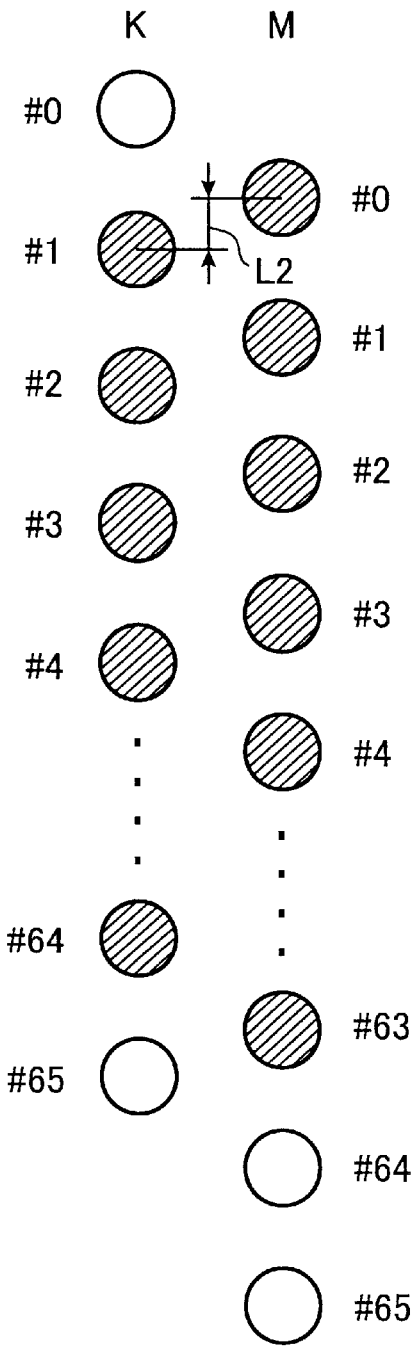
FIG.2(B) PRIOR ART
FIG. 2(B) is an explanatory diagram showing printed dot patterns by the two separate heads each formed with sixty-six nozzles for each color ink.
Figure 2C:
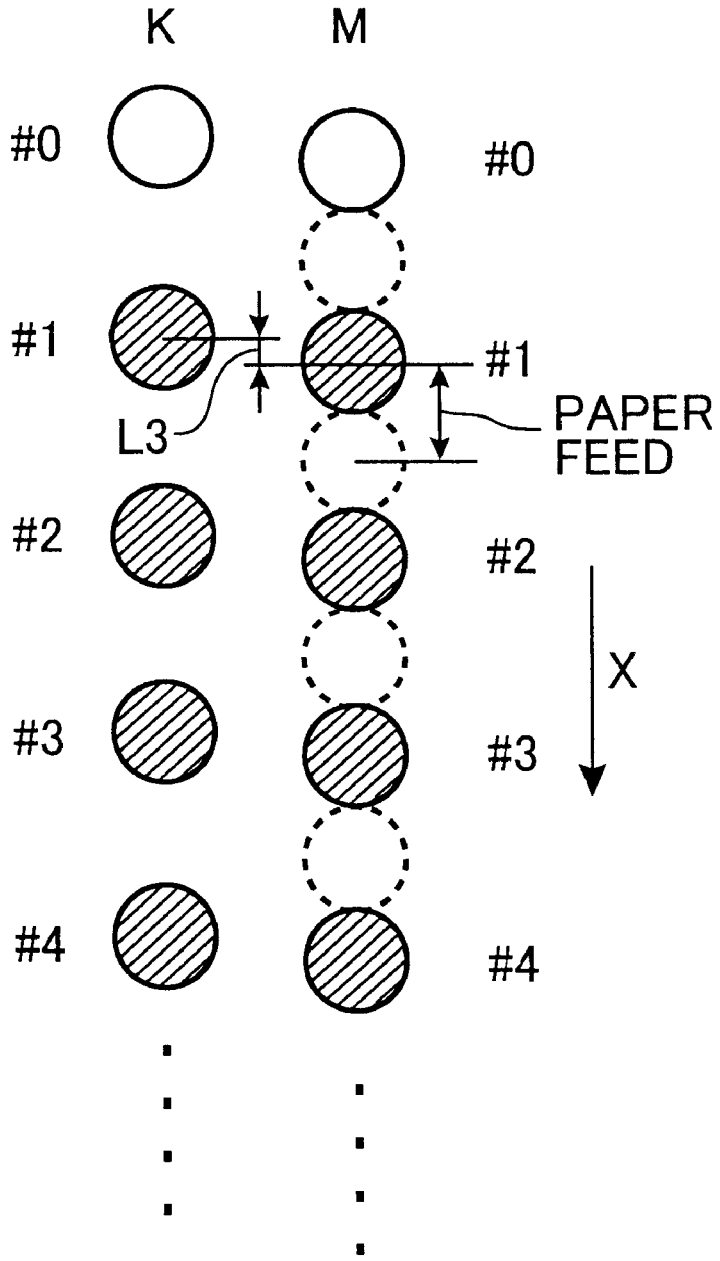
FIG. 2(C) is an explanatory diagram showing printed dot patterns according to a first embodiment of the invention.

According to the first embodiment, a software solution is employed to solve the dot shift problem. As the dot shift is substantially eliminated, a desirable print quality is attained. As shown in FIG. 2(C), a small amount of dot shift L3 still remains even after the dot shift adjustment according to the first embodiment is performed. However, it can be appreciated that the dot shift L3 is much smaller than the dot shift L1 or L2 shown in FIGS. 2(A) and 2(B).

A second embodiment of the present invention will next be described. The first embodiment employs a software solution to solve the dot shift problem. The second embodiment is directed to a combination of the software solution of the first embodiment and the solution using heads with superfluous nozzles as is done conventionally.

In the second embodiment, each of the nozzle arrays 25*a* through 25*d* in each of the print heads 17*a* and 17*b* includes sixty-six nozzles aligned at an interval of 1/150 inch (150 dpi). Sixty-four nozzles out of sixty-six are used for printing and the remaining two nozzles are not used therefor.

Figure 6:
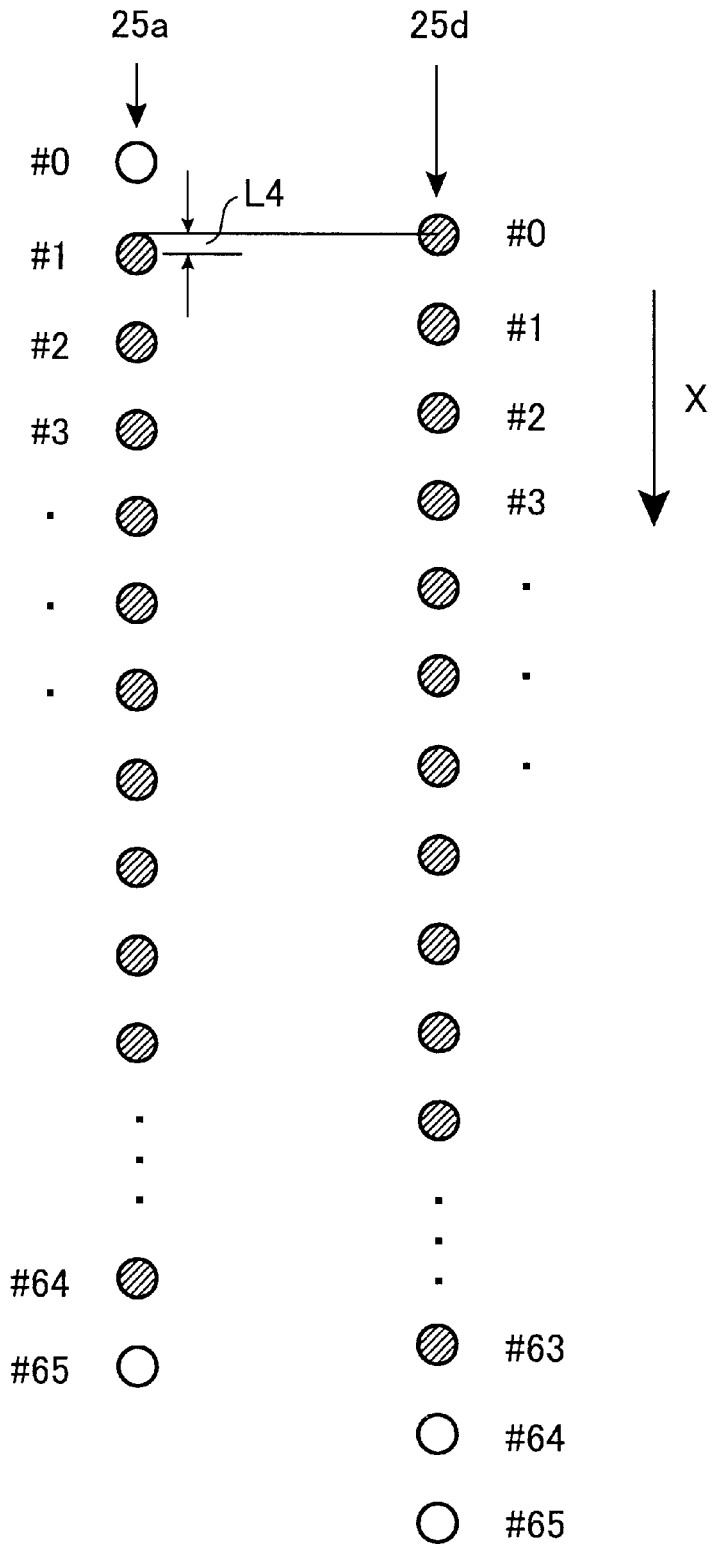
FIG. 6 is an explanatory diagram showing printed dot patterns according to the color ink jet printer according to the second embodiment of the present invention.

Neighboring nozzle pairs with less positional shift between the black and magenta nozzle arrays 25*a* and 25*d* are selected as is done conventionally. For example, for the dot shift as shown in FIG. 6, #1 to #64 nozzles are selected as enabled nozzles with respect to the nozzle array 25*a* and #0 to #63 nozzles are selected as enabled nozzles with respect to the nozzle array 25*d.* As such, the neighboring nozzle pairs with less positional shift can be used as compared with the case in which #0 to #63 nozzles are used with respect to both the nozzle arrays 25*a* and 25*d.* The information about the enabled and disabled nozzles is stored in the EEPROM 9 as the second set data. Storing the second set data in the EEPROM 9 can be accomplished through the manipulation of the operational panel 13.

As described, according to the second embodiment, conditions for physically reducing the dot shift is firstly determined, and to further reduce the dot shift which is still outstanding as a result of reduction of the dot shift according to the physical approach, the first set data is obtained as described in connection with the first embodiment. According to the second set data determined as described above, dots are printed using the black and magenta nozzles. Upon observing the printed results, determination is made as to the amount of dot shift in the auxiliary scanning direction and the direction in which the dot shift occurred. Based on the determination, the print head that is to be actuated first (hereinafter referred to as "reference head") is determined and also the amount of paper feed is determined to align the dots printed by the secondly actuated head with the dot printed by the reference head.

In the example shown in FIG. 6, the print paper 2 is fed in the direction indicated by an arrow X. The head 17*b* formed with the nozzle array 25*d* is the reference head. After printing with the reference head, the print paper 2 is fed to align the #1 black dot with the #0 magenta dot.

Upon storing the first and second set data in the EEPROM 9, the printer is sold on the market.

Figure 7:
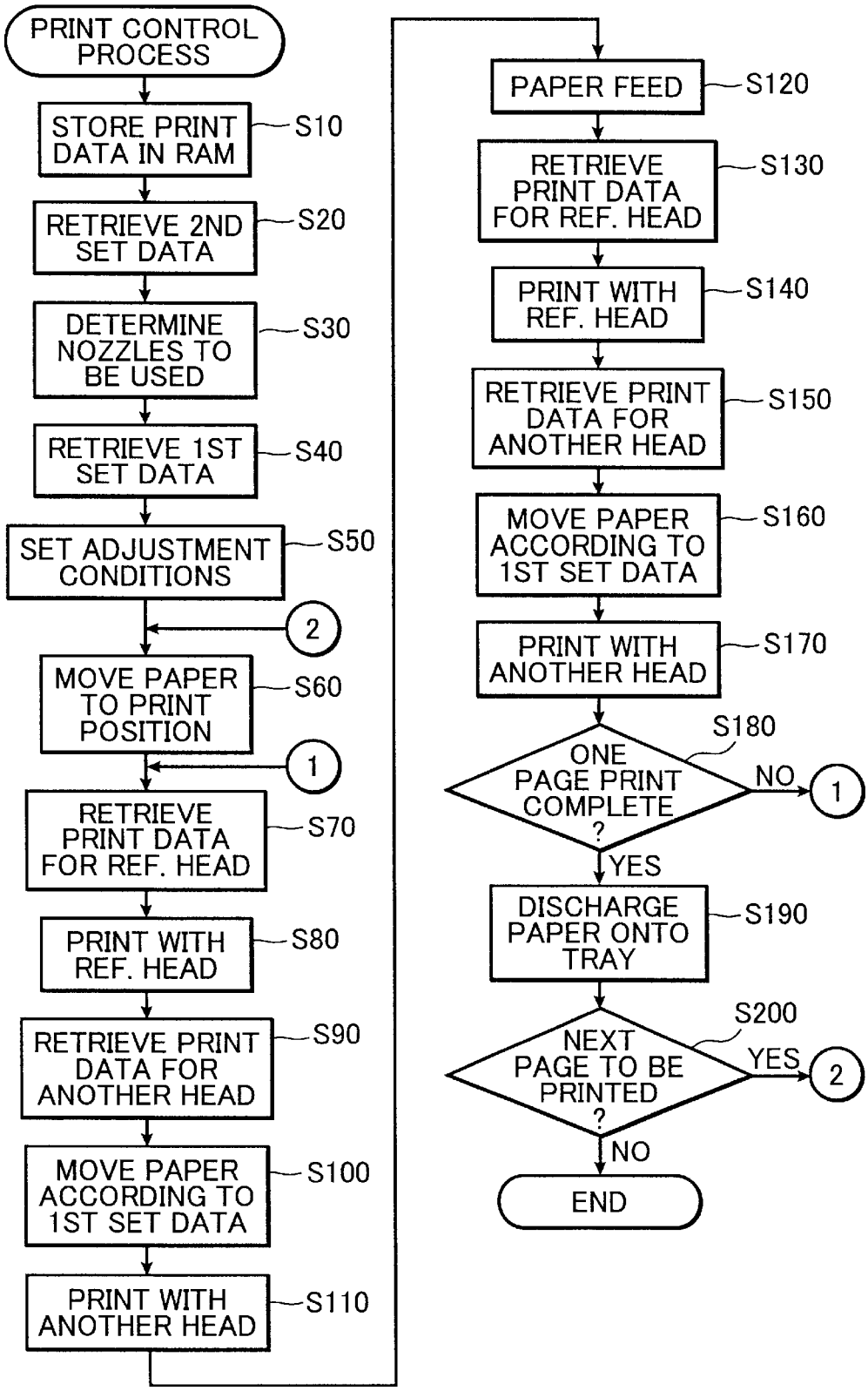
FIG. 7 is a flowchart illustrating a print control process according to a second embodiment of the invention.

Next, the print control process will be described with reference to the flowchart shown in FIG. 7.

First, the print data input from the personal computer 21 is stored in the RAM 7 (S10), and then the second set data is retrieved from the EEPROM 9 (S20). Based on the second set data, sixty-four nozzles to be used for printing are determined for each of the heads 17*a* and 17*b* (S30).

Next, the first set data is retrieved from the EEPROM 9 (S40). Based on the first set data, dot shift adjustment conditions are set (S50). The adjustment conditions includes designation of the reference head and also a paper feed amount for correcting the dot shift. After setting the adjustment conditions, the print paper 2 is transported by the paper feed motor 15 to the position where printing starts (S60).

One scan worth of print data applied to the reference head is retrieved from the print data stored in the RAM 7 (S70). The carriage motor 19 is driven to move the carriage 23 in the main scanning direction. While moving the carriage 23 in the main scanning direction, the reference head carries out printing (S80). After the print operations with the reference head, one scan worth of print data to be applied to another head is retrieved from the print data stored in the RAM 7 (S90). The paper feed motor 15 is driven to move the recording paper 2 a predetermined distance in the auxiliary scanning direction based on the first set data (S100). Then, the carriage motor 19 is driven to move the carriage 23 in the main scanning direction and printing is carried out by another head (S110).

Next, based on a predetermined paper feed amount stored in the ROM 3, the paper feed motor 15 is driven to move the print paper 2 for printing subsequent one scan worth of print data (S120). The subsequent one scan worth of print data to be applied to the reference head is retrieved from the data stored in RAM 7 (S130). The carriage motor 19 is driven to move the carriage 23 in the main scanning direction. During the movement of the carriage 23, the reference head carries out printing (S140). Similarly, the print data to be applied to another head is retrieved from the RAM 7 (S150). Similar to the operations executed in after moving the print paper 2 a predetermined distance in the auxiliary scanning direction (S160), the carriage motor 19 is driven to move the carriage 23 in the main scanning direction, during which time another print head carries out printing (S170).

Upon execution of S170, determination is made as to whether or not one page print is complete (S180). When one page print is not yet complete (S180: NO), the routine returns to S70 where the above-described processes are executed. On the other hand, when one page print is complete (S180: YES), the paper feed motor 15 is driven to discharge the print paper 2 onto a discharge tray (S190). Next, determination is made as to whether or not there remains print data for the subsequent page (S200). When the print data for the subsequent page remains (S200: YES), the processes of S60 and on are repeatedly executed. When there is no print data for the subsequent page (S200: NO), the processes end.

The printer of the second embodiment employs both the software solution according to the first embodiment and the conventional physical solution to solve the dot shift problem. Therefore, the dot shift is reduced to a considerable amount by virtue of the conventional physical solution and the remaining dot shift is further reduced to substantially zero by virtue of the software solution. As such, the dot shift adjustment can be effectively accomplished with the second embodiment.

Next, a third embodiment of the invention will be described.

In the third embodiment, an optimum print control process is determined based on the printed results obtained through various print processes. The first print process is to print dots with no dot shift adjustment. The second print process is the one described in the first embodiment. The third print process is to print dots upon selecting the neighboring nozzle pairs with less positional displacement on the heads having superfluous nozzles. The fourth print process is the one described in the second embodiment. Dots are printed on a single paper with the first to fourth print processes and the best print process giving the best print results is selected for installing or setting to the printer. These procedures are taken place before shipment of the printer.

Different head assemblies have different head displacements. Therefore, there may be a case where the third process is best suited for attaining the least dot shift. On the other hand, there may a case where the fourth process is not effective in reducing the dot shift. The reason for this is that the print paper can only be moved in one direction and the paper feed amount cannot be minutely controlled. A stepping motor used for feeding the print paper operates in a stepwise manner wherein the minimum paper feed amount is fixed. Therefore, the paper feed adjustment less than this fixed amount cannot be achieved. In the case where the fourth process is not applicable, it may be desirable to employ the third process. Also, there may be a case that satisfactory print results are obtained with the print process not performing any adjustments. In this case, while improved print results may be obtained with another print processes, selection of the first process is preferred. Because the first process is simpler than any other processes.

When the first and third print processes are selected, it is not necessary to print the dots according to the interlace method. The ink droplet ejections from the two separate heads on the same carriage can be done during the same scan of the carriage. As a result, the print time can be shortened.

While the various embodiments of the invention have been described in detail, it can be appreciated for those skilled in the art that the invention is not limited thereto but various changes and modifications are possible without departing from the scope and spirit of the invention. For example, each of the two heads may not be formed with two nozzle arrays but one of the heads is formed with one nozzle array and the other with three nozzles arrays. Also, the head assembly may include more than two heads. In this case, more than three scans of the head assembly are needed to accomplish separate droplet ejections from the heads more than two. Further, more than two pieces of the first set data are needed to this effect.

The invention can be applied to such an interlace printing that prints, for example, 300 dip resolution images using a head of 150 dpi nozzle pitch by interposing dot lines between preceding dot lines.

What is claimed is:

1. An ink jet printer comprising:

a carriage motor;

a head assembly including a carriage and two or more heads mounted on the carriage, the carriage being operatively, connected to said carriage motor and reciprocally moved back and forth in a main scanning direction to perform successive scans, each of the two or more heads being formed with at least one nozzle array having a plurality of nozzles aligned at an equipitch in an auxiliary scanning direction perpendicular to the main scanning direction, wherein to print dots on a plurality of dot lines, a series of scans are performed;

a paper feed motor for moving a print paper in the auxiliary scanning direction;

driving means for driving the two or more heads to eject ink droplets from the plurality of nozzles, said driving means driving different heads individually during different scans whereat each of the two or more heads completes printing of dots on a zone determined by a position in the auxiliary scanning direction of the each of the two or more heads mounted on the carriage; and control means for controlling said paper feed motor to move the print paper a relevant amount each time the each of the two or more heads completes printing of the dots on the zone.

2. The ink jet printer according to claim 1, further comprising a memory for storing first set data, the first set data containing data regarding paper feed amount of the print paper to be moved by said paper feed motor each time the each of the two or more heads completes printing of the dots on the zone, wherein said control means controls said paper feed motor based on the first set data.

3. The ink jet printer according to claim 1, wherein the first set data further contains data regarding which head among the two or more heads is to be actuated first among others in a first scan of the series of scans.

4. The ink jet printer according to claim 3, wherein said driving means firstly drives the head designated by the first set data in the first scan of the series of scans.

5. The ink jet printer according to claim 4, wherein an amount of movement of the print paper each time the each of the two or more heads completes printing of the dots on the zone is determined on a head basis.

6. An ink jet printer, comprising:

a carriage motor;

a head assembly including a carriage and two or more heads mounted on the carriage, the carriage being operatively connected to said carriage motor and reciprocally moved back and forth in a main scanning direction to perform successive scans, each of the two or more heads being formed with at least one nozzle array having a plurality of nozzles and at least one superfluous nozzle aligned at an equi-pitch in an auxiliary scanning direction perpendicular to the main scanning direction, wherein to print dots on a plurality of dot lines, a series of scans are performed;

a paper feed motor for moving a print paper in the auxiliary scanning direction;

a memory for storing first set data regarding paper feed amount to be moved by said paper feed motor each time the each of the two or more heads completes printing of the dots on a zone and second data regarding nozzles selected from the plurality of nozzles and at least one superfluous nozzle in each of the two or more heads, the nozzles being selected so that alignment errors of the nozzles in the two or more heads in the main scanning direction become minimum, the selected nozzles being used for ejecting ink droplets from the each of the two or more heads;

driving means for driving the two or more heads to eject ink droplets from the selected nozzles, said driving means driving different heads individually during different scans whereat each of the two or more heads completes printing of dots on the zone determined by a position in the auxiliary scanning direction of the each of the two or more heads mounted on the carriage; and control means for controlling said paper feed motor based on the first set data to move the print paper each time the each of the two or more heads completes printing of the dots on the zone.

7. A method of setting an optimum printing condition to an ink jet printer including a carriage motor, a head assembly including a carriage and two or more heads mounted on the carriage, the carriage being operatively connected to said carriage motor and reciprocally moved back and forth in a main scanning direction to perform successive scans, each of the two or more heads being formed with at least one nozzle array having a plurality of nozzles aligned at an equi-pitch in an auxiliary scanning direction perpendicular to the main scanning direction, wherein to print dots on a plurality of dot lines, a series of scans are performed, a paper feed motor for moving a print paper in the auxiliary scanning direction, driving means for driving the two or more heads to eject ink droplets from the selected nozzles, said driving means driving different heads individually during different scans whereat each of the two or more heads completes printing of dots on a zone determined by a position in the auxiliary scanning direction of the each of the two or more heads mounted on the carriage, and control means for controlling said paper feed motor to move the print paper each time the each of the two or more heads completes printing of the dots on the zone, the method comprising the steps of:

carrying out a first print pattern wherein the two or more heads print dots in the successive scans;

carrying out a second print pattern wherein alignment errors of the nozzles in the two or more heads occurring in the main scanning direction are reduced by moving the print paper a relevant amount each time the each of the two or more heads completes printing of the dots during one scan;

carrying out a third print pattern wherein used are the two or more heads formed with at least one nozzle array having a plurality of nozzles and at least one superfluous nozzle aligned at the equi-pitch in the auxiliary scanning direction, and nozzles to be used for printing are selected so that alignment errors of the nozzles in the two or more heads in the main scanning direction become minimum;

carrying out a fourth print pattern wherein using the two or more heads formed with at least one nozzle array having a plurality of nozzles and at least one superfluous nozzle aligned at the equi-pitch in the auxiliary scanning direction and selecting nozzles to be used for printing, alignment errors of the nozzles in the two or more heads occurring in the main scanning direction are reduced by moving the print paper a relevant amount each time the each of the two or more heads completes printing of the dots during one scan;

selecting one of the first to the forth patterns based on the printed results by the first to the fourth patterns; and setting the selected pattern to the ink jet printer for printing.

8. A droplet ejection device comprising:

a carriage motor;

a head assembly including a carriage and two or more heads mounted on the carriage, the carriage being operatively connected to said carriage motor and reciprocally moved back and forth in a main scanning direction to perform successive scans, each of the two or more heads being formed with at least one nozzle array having a plurality of nozzles aligned at an equi-pitch in an auxiliary scanning direction perpendicular to the main scanning direction, wherein to form dots on a plurality of dot lines, a series of scans are performed;

a droplet receiving medium feed motor for moving a droplet receiving medium in the auxiliary scanning direction;

driving means for driving the two or more heads to eject droplets from the plurality of nozzles, said driving means driving different heads individually during different scans whereat each of the two or more heads completes forming of dots on a zone determined by a position in the auxiliary scanning direction of the each of the two or more heads mounted on the carriage; and control means for controlling said droplet receiving medium feed motor to move the droplet receiving medium a relevant amount each time the each of the two or more heads completes forming of the dots on the zone.

9. The droplet ejection device according to claim 8, further comprising a memory for storing first set data, the first set data containing data regarding droplet receiving medium feed amount of the droplet receiving medium to be moved by said droplet receiving medium feed motor each time the each of the two or more heads completes forming of the dots on the zone, wherein said control means controls said droplet receiving medium feed motor based on the first set data.

10. The droplet ejection device according to claim 8, wherein the first set data further contains data regarding which head among the two or more heads is to be actuated first among others in a first scan of the series of scans.

11. The droplet ejection device according to claim 10, wherein said driving means firstly drives the head designated by the first set data in the first scan of the series of scans.

12. The droplet ejection device according to claim 11, wherein an amount of movement of the droplet receiving medium each time the each of the two or more heads completes forming of the dots on the zone is determined on a head basis.

13. A droplet ejection device comprising:

a carriage motor;

a head assembly including a carriage and two or more heads mounted on the carriage, the carriage being operatively connected to said carriage motor and reciprocally moved back and forth in a main scanning direction to perform successive scans, each of the two or more heads being formed with at least one nozzle array having a plurality of nozzles and at least one superfluous nozzle aligned at an equi-pitch in an auxiliary scanning direction perpendicular to the main scanning direction, wherein to form dots on a plurality of dot lines, a series of scans are performed;

a droplet receiving medium feed motor for moving a droplet receiving medium in the auxiliary scanning direction;

a memory for storing first set data regarding droplet receiving medium feed amount to be moved by said droplet receiving medium feed motor each time the each of the two or more heads completes forming of the dots on a zone and second data regarding nozzles selected from the plurality of nozzles and at least one superfluous nozzle in each of the two or more heads, the nozzles being selected so that alignment errors of the nozzles in the two or more heads in the main scanning direction become minimum, the selected nozzles being used for ejecting droplets from the each of the two or more heads;

driving means for driving the two or more heads to eject droplets from the selected nozzles, said driving means driving different heads individually during different scans whereat each of the two or more heads completes forming of dots on the zone determined by a position in the auxiliary scanning direction of the each of the two or more heads mounted on the carriage; and control means for controlling said droplet receiving medium feed motor based on the first set data to move the droplet receiving medium each time the each of the two or more heads completes forming of the dots on the zone.

14. A method of setting an optimum droplet ejecting condition to a droplet ejection device including a carriage motor, a head assembly including a carriage and two or more heads mounted on the carriage, the carriage being operatively connected to said carriage motor and reciprocally moved back and forth in a main scanning direction to perform successive scans, each of the two or more heads being formed with at least one nozzle array having a plurality of nozzles aligned at an equi-pitch in an auxiliary scanning direction perpendicular to the main scanning direction, wherein to form dots on a plurality of dot lines, a series of scans are performed, a droplet receiving medium feed motor for moving a droplet receiving medium in the auxiliary scanning direction, driving means for driving the two or more heads to eject droplets from the selected nozzles, said driving means driving different heads individually during different scans whereat each of the two or more heads completes forming of dots on a zone determined by a position in the auxiliary scanning direction of the each of the two or more heads mounted on the carriage, and control means for controlling said droplet receiving medium feed motor to move the droplet receiving medium each time the each of the two or more heads completes forming of the dots on the zone, the method comprising the steps of:

carrying out a first form pattern wherein the two or more heads form dots in the successive scans;

carrying out a second form pattern wherein alignment errors of the nozzles in the two or more heads occurring in the main scanning direction are reduced by moving the droplet receiving medium a relevant amount each time the each of the two or more heads completes forming of the dots during one scan;

carrying out a third form pattern wherein used are the two or more heads formed with at least one nozzle array having a plurality of nozzles and at least one superfluous nozzle aligned at the equi-pitch in the auxiliary scanning direction, and nozzles to be used for forming are selected so that alignment errors of the nozzles in the two or more heads in the main scanning direction become minimum;

selecting one of the first to the third patterns based on the formed results by the first to the third patterns; and setting the selected pattern to the droplet ejection device for forming.

15. The method according to claim 14, further comprising the step of carrying out a fourth print pattern wherein using the two or more heads formed with at least one nozzle array having a plurality of nozzles and at least one superfluous nozzle aligned at the equi-pitch in the auxiliary scanning direction and selecting nozzles to be used for forming, alignment errors of the nozzles in the two or more heads occurring in the main scanning direction are reduced by moving the droplet receiving medium a relevant amount each time the each of the two or more heads completes forming of the dots during one scan, wherein one of the first to the fourth patterns are selected based on the formed results by the first to the fourth patterns.

* * * * *